US005375751A

United States Patent [19]

Mäkinen

[11] Patent Number: 5,375,751

[45] Date of Patent: Dec. 27, 1994

[54] METHOD AND APPARATUS FOR SEVERING A PAPER WEB, PARTICULARLY A PERFORATED PAPER WEB

[75] Inventor: Jukka Mäkinen, Hollola, Finland

[73] Assignee: Valmet Paper Machinery, Helsinki, Finland

[21] Appl. No.: 952,055

[22] Filed: Sep. 28, 1992

[30] Foreign Application Priority Data

Sep. 27, 1991 [FI] Finland ..... 914549

[51] Int. Cl.[5] ..... B26F 3/02

[52] U.S. Cl. ..... 225/1; 225/97; 225/105

[58] Field of Search ..... 225/1, 93, 101, 103–105, 225/97

[56] References Cited

U.S. PATENT DOCUMENTS

| | | | |
|---|---|---|---|
| 3,794,228 | 2/1974 | Colwill et al. | 225/93 |
| 3,863,821 | 2/1975 | Van Bennekom | 225/93 |
| 4,730,761 | 3/1988 | Spano | 225/2 |
| 4,946,086 | 8/1990 | Suuronen et al. | 225/4 |
| 5,100,040 | 3/1992 | Kunreuther et al. | 225/105 |

FOREIGN PATENT DOCUMENTS

| | | | |
|---|---|---|---|
| 0144182 | 11/1981 | Japan | 225/105 |

*Primary Examiner*—Eugenia Jones

*Attorney, Agent, or Firm*—Cohen, Pontani, Lieberman, Pavane

[57] ABSTRACT

A method and an assembly for severing a perforated continuous form along two lines. The paper web is clamped by three clamping elements (6, 11, 15) extending essentially orthogonal over the entire width of the paper web (4) against an anvil plate (1) placed on the opposite side of the paper web so that the perforations (5) of the web remain aligned between the clamping elements (6, 11, 15) and the clamped paper web is tensioned by actuating severing elements (5, 16) placed between the clamping elements (6, 11, 15) to enter anvil grooves (12, 17) made in the anvil plate in order to sever the paper web at the perforation (5) by increased tensional stress. The apparatus provides a fast and reliable function.

8 Claims, 2 Drawing Sheets

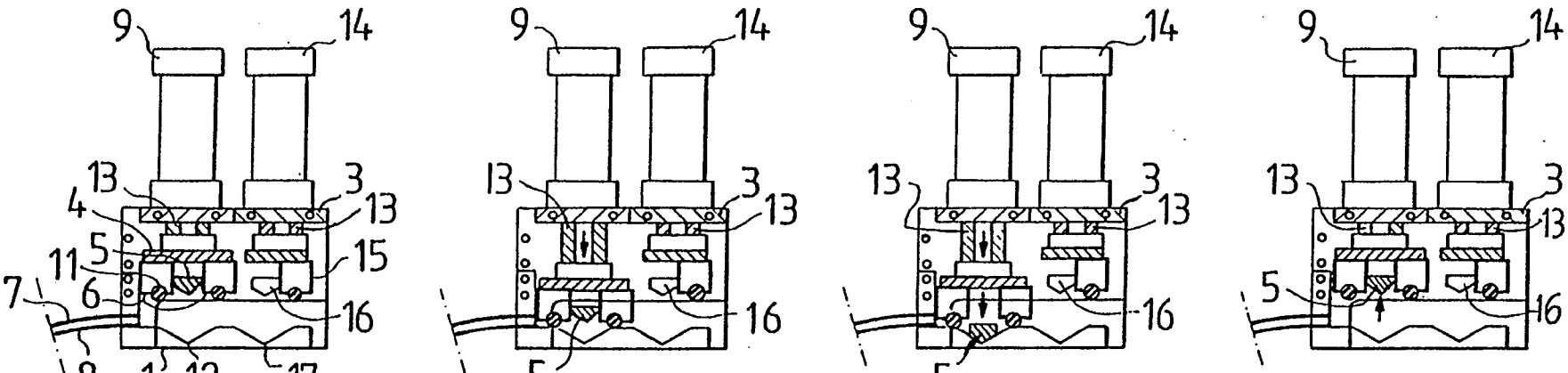
Fig.1
Fig.2
Fig.3
Fig.4
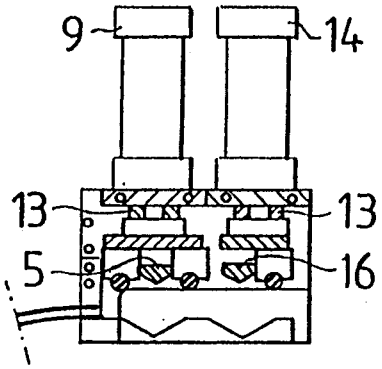
Fig.5
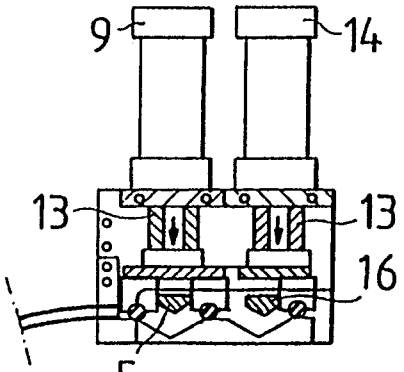
Fig.6
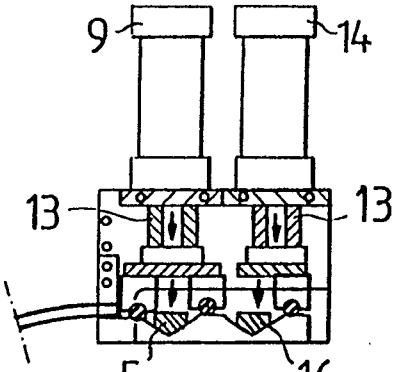
Fig.7
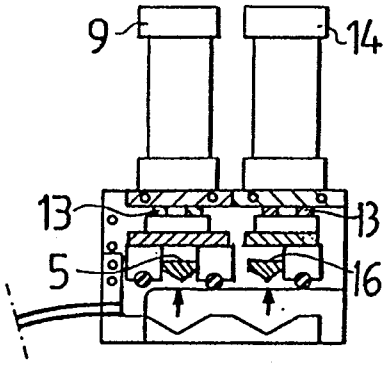
Fig.8

METHOD AND APPARATUS FOR SEVERING A PAPER WEB, PARTICULARLY A PERFORATED PAPER WEB

BACKGROUND OF THE INVENTION

1. Field of the Invention

The present invention relates to a method of severing a paper web suited to separating a preset length of paper from the web.

The invention also concerns an apparatus suited to implement the method.

2. Description of the Related Art

The use of perforated paper web increases with the growing number of computer applications. Paper is conventionally packed in folded form in stacks, whereby the long paper web is perforated at the folds. The paper is fed to a printing machine or printer, after which the paper is severed to sheets of desired length as necessary.

In prior-art applications the perforated paper web has been severed manually without the use of tools. Alternatively, the paper web has been severed against a toothed blade extending over the width of the web by pressing the web either manually or with the help of a mechanical device against the blade. Cutting-blade severing devices are also conventionally used, whereby a nonperforated paper web can be cleanly severed.

According to the U.S. Pat. Nos. 3,794,228 and 4,946,082, a paper web resting on clamping elements is severed by tensioning the web by means of a severing element placed between said clamping elements. In such arrangements the separation line of the perforated continuous form is transferred to coincide with the severing element, the form is clamped in place by two frictional clamp surfaces and the severing element is projected against the tensioned, clamped web, whereby the paper web is severed at the perforation line. Such apparatuses achieve a short work cycle of separation, but they are not applicable to severing the so-called manufacturer-identifying logotype label web and separating the label from the web.

The perforated manufacturer-identifying logotype label web is a continuous form which carries a chain of labels separated from each other by a first perforation. The upper or lower edge of the labels have a manufacturer's identifier area separated from the basic part of label by a second perforation. Such a label web is used for marking a product without information on the manufacturer or vendor. For example, if not all manufactured paper rolls are desired to be marked so as to include the manufacturer's logotype for reasons related to retail or other specific sales activities wherein a simple conventional label containing paper roll information only is desired, such a logotype label web is advantageously used. Retailers and paper warehouses also typically request their paper orders to be delivered without the manufacturer's identification so as to permit the identification of the paper by their own logotype prior to retail sales deliveries. Perforated logotype label web allows the use of single printer fed by a single type of continuous form for printing both the identifier-free and logotype-identifier containing labels. The nonidentifying label is produced by simply separating the basic part of the label along the first perforation before placing the label onto the roll. Prior to the availability of the logotype label web, the printing and placing of the identifier-free and logotype-identifier containing labels needed the use of two label printers.

The logotype area is today separated from the label web by means of various cutting blade devices or the logotype area can be separated using the same cutting apparatus which serves for separating the labels from the continuous form. For current applications such severing methods have, however, an excessively long work cycle of separating the logotype area. In the cutting blade-type severing methods, the feed of the continuous form must be stopped and the form clamped for the duration of the severing operation. When a single severing device is also used for separating the logotype area, two cutting operations must be performed, whereby the duration of the work cycle is obviously doubled.

SUMMARY OF THE INVENTION

It is an object of the present invention to overcome the disadvantages encountered in the above-described techniques and to achieve an entirely novel method and apparatus for severing a paper web offering rapid separation of the logotype area from a label.

In accordance with the present invention, the method of severing a label from a continuous perforated form includes the steps of clamping the continuous form by two label clamping elements extending essentially orthogonally over the continuous perforated form against a lower plate placed on the opposite side of the form so that one the perforated lines is located between the clamping elements, tensioning the clamped continuous perforated form by pressing a severing element located between the label clamping elements toward an anvil groove located on the opposite side of the continuous form in the lower plate and severing the continuous form at the perforation line by means of elevated tensional stress, clamping the continuous perforated form simultaneously by an additional independently movable label clamping element, such that a perforation between the basic part of the label and the logotype area is located between the additional label clamping element and the two label clamping elements, and tensioning the clamped continuous perforated form by pressing an additional severing element located between the additional label clamping element and the two label clamping elements toward an additional anvil groove located on the opposite side of the continuous form in the lower plate and severing the continuous form at the perforation between the logotype area and the basic part of the label by means of elevated tensional stress.

The apparatus for severing a perforated form according to the present invention includes a frame having at least two side elements, an anvil plate and an upper plate. Two label clamping elements are mounted at a distance from each other on the frame so as to be movable against the anvil plate. The label clamping elements are aligned relative to the anvil plate and essentially orthogonal to the feed direction of the continuous form so as to extend at least over the width of the form. At least one movable severing element is mounted between the label clamping elements so as to be pressable against the anvil plate. The anvil plate has an anvil groove located opposite the severing element. The anvil groove is capable of receiving the severing element. At least one additional clamping element is mounted at a distance from the two label clamping elements. The additional label clamping element extends at least essentially over the entire width of the continuous form and can be pressed against the anvil plate independently of the two other label clamping elements. An additional severing element is mounted between the additional clamping element and the two label clamping elements so as to be independently pressable against the anvil plate. The anvil plate has an additional anvil groove located below the additional severing element for receiving the additional severing element.

The invention offers significant benefits.

The method according to the invention performs the severing operation exactly at the perforation for both severing lines. The distance between the support elements is, however, large thus relaxing the alignment accuracy requirements of the label web also for the removal of the logotype area. The severing apparatus has a fast work cycle and the severing of both the label and its logotype area takes place simultaneously. The separated logotype area is removed from the path of the label by a compressed-air jet, and the removal of the separated part does not essentially extend the work cycle duration. The elements forming the label severing assembly and logotype severing assembly are comprised of identical mechanical components, thus making the production of the apparatus simple and its construction uncomplicated. The label clamping and severing movement is advantageously implemented in such a manner that the gap of the apparatus can be opened wide at the feed instant without compromising the short duration of the entire severing operation.

BRIEF DESCRIPTION OF THE DRAWINGS

The invention is next examined in greater detail by reference to an exemplifying embodiment illustrated in the attached drawing, in which FIGS. 1–4 show a paper web severing apparatus according to the invention in cross-sectional view for the different work phases of separating the label.

FIGS. 5–8 show the apparatus illustrated in the diagrams of the above-mentioned figures for the different work phases of severing the label and the logotype area.

DESCRIPTION OF THE PREFERRED EMBODIMENT

Figure 9:
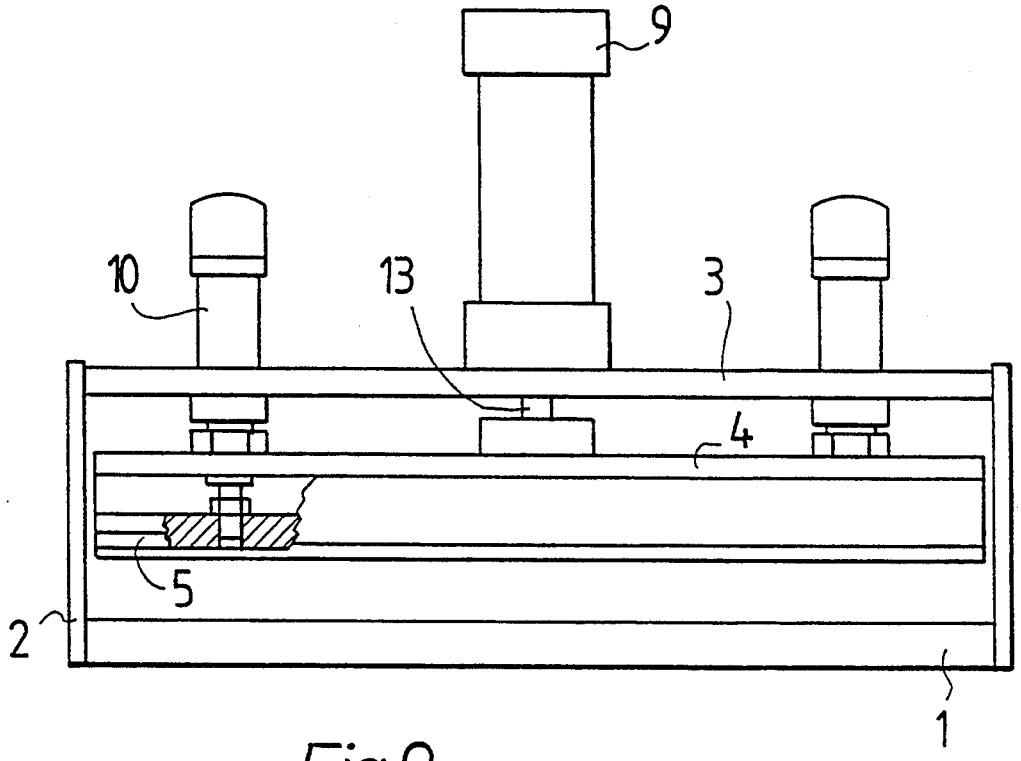
FIG. 9 shows the apparatus illustrated in the diagrams of the above-mentioned figures in partially longitudinally sectioned view.

The frame of the apparatus according to the invention is comprised of a lower plate 1 mounted between sides 2 and of two adjacently mounted upper plates 3. Attached to the first upper plate 3 is a first clamping cylinder 9, whose rods 13 pass through the upper plate 3. The clamping cylinder 9 is a nonrotating cylinder with a dual rod 13. The ends of the rods 13 are connected to a press plate 4. Both long edges of the press plate 4 are provided with a press clamp 6 whose lower edge is covered by a rubber strip 11. Severing actuator cylinders 10 are mounted close to the ends of the press plate 4. The rods of the severing actuator cylinders 10 pass through the press plate 4 and carry a severing blade 5 attached to their lower ends. The lower plate 1 has a V-shaped anvil groove 12 and the press clamps 6 of the press plate 4 are vertically aligned above the horizontal areas running along the edges of the groove 12, while the severing blade 5 is aligned above the bottom of the groove 12.

The second upper plate 3 carries an equivalent assembly to that described above with the exception that the press plate 4 has only a single press clamp, namely the press clamp 15 of the logotype are, attached to it. A severing blade 16 for the separation of the logotype area is mounted between the logotype area press clamp 15 and the adjacent severing assembly. An anvil groove 17 is adapted to the lower plate 1 below the severing blade 16. Feed guides 7 and 8 for the continuous label form are adapted to the frame of the apparatus on the first severing assembly side. The guides 7, 8 are formed by two curved adjacently mounted metal plates outdistanced from each other by a gap through which the continuous label form is fed into the severing apparatus.

FIGS. 1–4 illustrate the function of the apparatus when the label is severed complete with the logotype area from the continuous form. In this case the continuous form is fed between the guides 7, 8 through the gap of the severing apparatus and the feed movement is stopped when the label edge has entered sufficiently far so that the perforated severing line is coincident with the anvil groove 12. The position of the label can be detected by a photoelectric sensor, for instance. As the continuous form stops from moving, the clamping cylinder 9 performs a downward stroke, whereby the press clamps 6 compress the label form against the lower plate 1 and hold it in place (FIG. 2). The short-stroke severing cylinders mounted to the press plate 4 make a rapid stroke downward and the severing blade 5 imposes a tensional stress on the paper web that causes ripping of web perforation and consequent separation of the label (FIG. 3). After the severing phase the clamping and severing cylinders 9, 10 perform a return stroke to their upper positions (FIG. 4). The separated label is next placed by a labelling apparatus onto the roll. Because the severing cylinders 10 are mounted to the press plate 4 so as to move with it, the gap can be opened sufficiently wide, thus making the feed of the continuous form easy and yet keeping the duration of the severing operation relatively short.

Separation of the logotype area in conjunction with severing the label takes place in a similar manner. The severing line of the logotype area is arranged to coincide with the anvil groove 17 of the logotype area when the label severing line is aligned at the label-separating anvil groove 12. During the severing stroke, the logotype area press clamp 15 is pressed against the planar surface of the lower plate 1 by a second clamping cylinder 14 simultaneously with the downward stroke of the first clamping cylinder 9 (FIG. 6). The logotype area is separated by the logotype severing blade 16 simultaneously with the severing of the label basic part (FIG. 7). After the severing operation is completed, the actuator cylinders 9, 10 and 14 perform a return stroke to their upper positions (FIG. 8) and the separated logotype area is removed with the help of a compressed-air jet.

In addition to the above-described, the present invention can have alternative embodiments. Pneumatic cylinders are preferably employed as the actuator cylinders, but if so desired, any other suitable linear actuator such as an hydraulic or electrical actuator can be used. The cylinders actuating the severing element 5 can be replaced by passive, energy-storing elements such as springs. The orientation of the apparatus need not be that shown in the diagrams, but as well, the lower plate acting as the anvil plane can be placed above the pressing elements and severing blades.

I claim:

1. A method of severing a label from a continuous perforated form, the form being perforated along perforated lines, each label comprising a basic part and logotype area and a perforation connecting the basic part to the logotype area, the method comprising the steps of:

clamping the continuous perforated form by two first label clamping elements extending essentially orthogonally over the continuous perforated form against a lower plate located on the opposite side of the form, such that one of the perforated lines is located between the two first label clamping elements;

tensioning the clamped continuous perforated form by pressing a first severing element located between the two first clamping elements toward a first anvil groove located on the opposite side of the continuous perforated form in the lower plate and severing the continuous perforated form at the perforated line located between the two first clamping elements by means of elevated tensional stress;

clamping the continuous perforated form by a second independently movable label clamping element simultaneously with the clamping by the two first label clamping elements, such that the perforation between the basic part and the logotype area of the label is located between the second independently movable label clamping element and the two first label clamping elements; and tensioning the clamped continuous perforated form by pressing a second severing element located between the second label clamping element and the two first label clamping elements toward a second anvil groove in the lower plate located on the opposite side of the continuous perforated form and severing the continuous perforated form at the perforation between the basic part and the logotype area of the label by means of elevated tensional stress.

2. An apparatus for severing a label from a continuous form, the continuous form being perforated along perforated lines and having a width, each label having a basic part and a logotype area and a perforation connecting the basic part to the logotype area, the apparatus comprising:

a frame having at least two side elements (2), an anvil plate (1), first and second upper plates (3), and means for guiding the continuous form in a feeding direction;

two first label clamping elements (6, 11) mounted at a distance from each other on the frame so as to be movable against the anvil plate (1), the two first clamping elements being aligned relative to the anvil plate and essentially orthogonal to the feeding direction of the continuous form so as to extend at least over the entire width of the form;

at least one first severing element (5) mounted between the two first label clamping elements so as to be pressable against the anvil plate;

the anvil plate (1) having a first anvil groove (12) located opposite the severing element (5), the first anvil groove (12) being configured to receive the first severing element (5);

at least one second clamping element (15) mounted at a distance from the two first label clamping elements, the second clamping element extending at least essentially over the entire width of the continuous form and being pressable against the anvil plate (1) independently of the two first label clamping elements;

a second severing element (16) mounted between the second clamping element (15) and the two first label clamping elements (6, 11) so as to be independently pressable against the anvil plate (1); and the anvil plate having a second anvil groove (17) located opposite the second severing element (15) and configured for receiving the second severing element (15).

3. The apparatus as defined in claim 2, wherein the two first label clamping elements (6, 11) are mounted to a press plate (4), further comprising at least one linear actuator (9) for connecting the press plate (4) to the first upper plate (3) of the frame.

4. The apparatus as defined in claim 3, wherein the first severing element (5) is connected to the press plate (4) via at least one second linear actuator (10).

5. The apparatus as defined in claim 3, wherein the at least one actuator is a pneumatic cylinder (9) with dual rods (13) connected to the press plate (4), wherein the cylinder (9) is connected to the first upper plate of the apparatus frame.

6. The apparatus as defined in claim 2, wherein the second clamping element (15) is connected to a press plate (4), further comprising at least one linear actuator (14) for connecting the press plate (4) to the apparatus frame.

7. The apparatus as defined in claim 6, wherein the second severing element (16) is connected to the press plate (4) via at least one second linear actuator (10).

8. The apparatus as defined in claim 6, wherein the at least one linear actuator is a pneumatic cylinder (14) with dual rods (13) connected to the press plate (4), wherein the cylinder (14) is connected to the second upper plate of the apparatus frame.

* * * * *